US005481777A

United States Patent [19]

Nenninger

[11] Patent Number: 5,481,777

[45] Date of Patent: Jan. 9, 1996

[54] RELEASABLE MOP HEAD

[76] Inventor: Charles L. Nenninger, 335 Dena La., Cape Girardeau, Mo. 63701

[21] Appl. No.: 285,073

[22] Filed: Aug. 3, 1994

[51] Int. Cl.[6] ..... A47L 13/24

[52] U.S. Cl. ..... 15/151; 15/229.2

[58] Field of Search ..... 15/147.1, 150–153, 15/173, 229.1–229.9

[56] References Cited

U.S. PATENT DOCUMENTS

| | | | |
|---|---|---|---|
| 131,674 | 9/1872 | Fitzhugh | 15/147.1 |
| 365,287 | 6/1887 | Whitemore | 15/151 |
| 512,492 | 1/1894 | Triphagen | 15/151 |
| 589,351 | 8/1897 | Humbach | 15/151 |
| 615,410 | 12/1898 | Parks | 15/151 |
| 644,925 | 3/1900 | Kahl | 15/151 |
| 798,134 | 8/1905 | Kelley | 15/151 |
| 911,773 | 2/1909 | Sourek | 15/151 |
| 1,245,990 | 11/1917 | Shannahan | 15/151 |
| 1,268,769 | 6/1918 | Poole | 15/151 |
| 1,369,095 | 2/1921 | Gardner | 15/151 |
| 1,641,034 | 8/1927 | Harber | 15/151 |
| 1,759,061 | 5/1930 | Morris et al. | 15/151 |
| 2,014,755 | 9/1935 | Wiemer | 15/151 |
| 2,122,164 | 6/1938 | Van Buskirk | 15/151 |
| 2,305,352 | 12/1942 | Helminiak | 15/151 |
| 2,712,144 | 7/1955 | Dunn | 15/151 |
| 3,447,183 | 6/1969 | McClung et al. | 15/151 |
| 4,850,072 | 7/1989 | Smith | 15/151 |

FOREIGN PATENT DOCUMENTS

| | | | |
|---|---|---|---|
| 932004 | 11/1947 | France | 15/151 |
| 466378 | 10/1951 | Italy | 15/152 |

*Primary Examiner*—Mark Spisich

*Attorney, Agent, or Firm*—Senniger, Powers, Leavitt & Roedel

[57] ABSTRACT

A mop head for releasably securing absorbent mop material to a handle comprises a mount for the absorbent material having a reaction surface thereon shaped and arranged for receiving the absorbent material thereacross and a clamp member attached to the mop head for movement between a clamp position in which the clamp member is located relatively close to the reaction surface and is adapted to engage the absorbent material to clamp it against the reaction surface and a release position in which the clamp member is located relatively farther away from the reaction surface and is adapted to release the absorbent material for removal of the absorbent material from the mop head. The mop head further includes a mechanism for urging the clamp member toward the reaction surface. The urging mechanism is selected to have sufficient strength to hold the absorbent material on the mop head when used for mopping.

18 Claims, 1 Drawing Sheet

RELEASABLE MOP HEAD

BACKGROUND OF THE INVENTION

This invention relates generally to mops and, more particularly, to mops having mop heads which releasably secure absorbent materials to handles of the mops.

Typically, a mop has a collection of thrums or rags (i.e., absorbent material) which are permanently fastened to the handle by a mop head. Although such a mop is generally satisfactory, the thrums or rags of this mop tend to become dirty and worn out. Cleaning the absorbent material after mopping an area involves soaking the rags in water and wringing the rags dry by a wringer. While the wringer removes the water and some of the dirt, the rags are still not entirely clean. Furthermore, the absorbent material wears out or is torn from the handle by the wringer causing the mop to clean less effectively. Thus, while the handle and mop head are still in perfect working condition, the worn out, relatively inexpensive absorbent material needs to be replaced. However, in practice, the entire mop is discarded since the absorbent material is permanently attached to the handle of the mop.

SUMMARY OF THE INVENTION

Among the several objects and features of the present invention may be noted the provision of a mop head which releasably secures absorbent material to the handle; the provision of such a mop head which simplifies and improves the cleaning of the absorbent material; the provision of such a mop head which permits the reconditioning of the mop by allowing replacement of the absorbent material; the provision of such a mop head which securely holds the absorbent material to the handle; and the provision of such a mop head which is simple and inexpensive to manufacture.

Generally, a mop of the present invention comprises a handle, an absorbent material, and a mop head for releasably securing the absorbent material to the handle. The mop head includes a mount for the absorbent material having a reaction surface thereon shaped and arranged for receiving the absorbent material thereacross, and a clamp member attached to the mop head for movement between a clamp position in which the clamp member is located relatively close to the reaction surface and is adapted to engage the absorbent material to clamp it against the reaction surface and a release position in which the clamp member is located relatively farther away from the reaction surface and is adapted to release the absorbent material for removal of the absorbent material from the mop head. The mop head further includes means for urging the clamp member toward the reaction surface. The urging means is selected to have sufficient strength to hold the absorbent material on the mop head when used for mopping.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
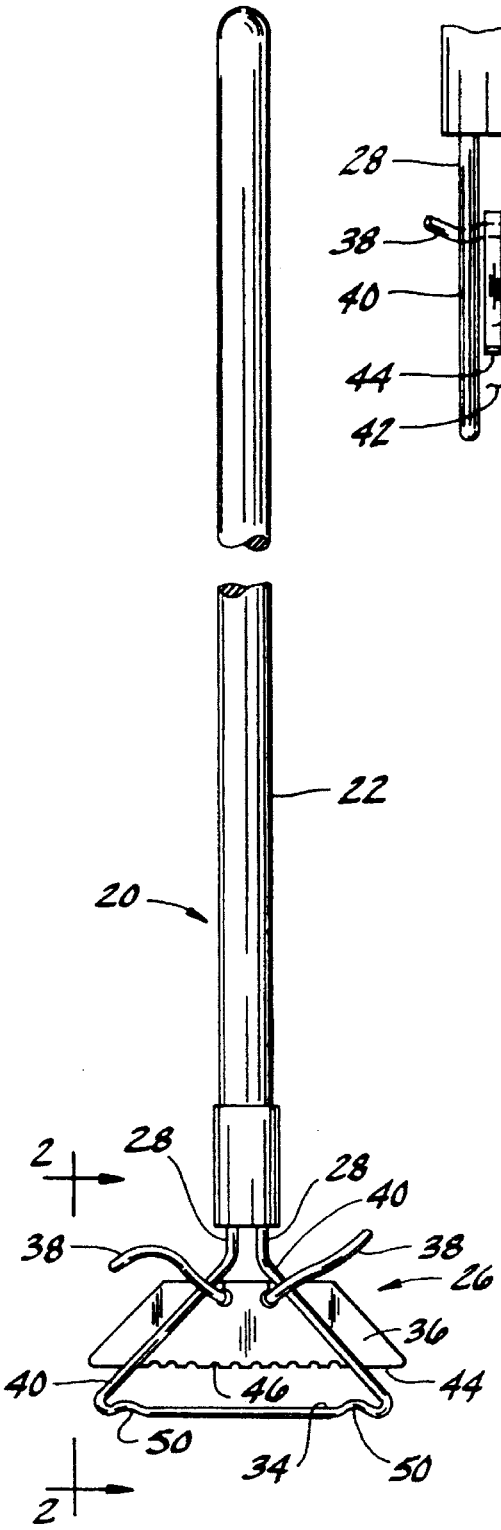
FIG. 1 is a side elevational view of a mop with the absorbent material not attached.
Figure 3:
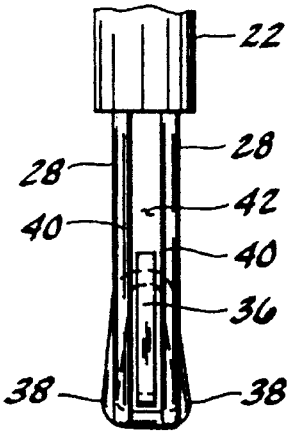
FIG. 3 is a view similar to FIG. 2 with the clamp member pulled downwardly by the resilient members.

Referring now to FIGS. 1 and 3 of the drawings, a mop of the present invention for cleaning the surface of floors is indicated generally at 20. The mop 20 comprises a handle 22, an absorbent material 24 and a mop head, indicated generally at 26, for releasably securing the absorbent material to the mop handle. The handle 22 of the mop 20 is preferably made of wood or plastic and is designed to be of lightweight construction. The handle 22 has four holes (not shown) in the bottom of the handle for receiving connector portions, each indicated at 28, of the mop head 26. The connector portions 28 are secured in the holes by press fitting the connector portions therein.

The absorbent material 24 is preferably made of an absorbent cloth or other suitable absorbent material. The absorbent material 24 has a narrow gathered portion (not shown) at the mid-point of the absorbent material. Some of the absorbent material 24 falls to one side of the gathered portion, the remaining absorbent material falls to another side of the gathered portion.

The mop head 26 includes a pair of spaced apart stirrups 40 (together constituting the "mount" in the preferred embodiment) defining a reaction surface 34 (FIG. 1) shaped and arranged for receiving the absorbent material 24 thereacross (FIG. 3). Each stirrup 40 is preferably made of aluminum or other strong, relatively rigid material. Each stirrup 40 terminates at two ends and is configured such that, in the preferred embodiments the ends define the parallel, spaced apart connector portions 28 extending upwardly away from the stirrup 40.

The interior, lower portion of the stirrups define the reaction surface 34 (FIG. 1). This surface 34 is shaped and arranged for receiving the absorbent material 24 thereacross (FIG. 3). The absorbent material 24, as situated on the mop head 26, extends through each stirrup 40 so that it rests on the lower, interior surface of each stirrup. The absorbent material 24 is routed through the stirrups 40 such that the gathered portion of the absorbent material is positioned between the mount members. For this purpose, the gathered portion of the absorbent material 24 is preferably elongate.

Figure 2:
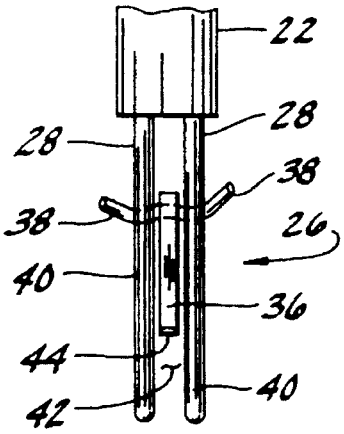
FIG. 2 is a side elevational view taken along line 2—2 of FIG. 1.

As shown in FIGS. 1 and 2, the mop head 26 further includes a clamp member 36 disposed in a guideway 42 defined by the stirrups 40 of the mop head 26. The clamp member 36 comprises a thin, flat plate received in the guideway 42 between the stirrups 40. The plate 36 and stirrups 40 are sized and shaped so that the plate protrudes laterally outwardly from between the stirrups from opposite sides thereof (FIG. 1). The plate 36 further has a bottom edge 44 with a portion 46 of the bottom edge being serrated to facilitate gripping the absorbent material 24. The plate 36 is captured by the stirrups 40 in the guideway 42 for movement between a clamp position (FIG. 3) and a release position (FIG. 2). In the clamp position, the plate 36 is located relatively close to the reaction surface 34 and at least the serrated portion 46 of the bottom edge 44 engages the absorbent material 24 to clamp it against the reaction surface. In the release position, the plate 36 is located relatively farther away from the reaction surface 34 and is adapted to release the absorbent material 24 from the stirrups 40 for removal of the absorbent material from the mop head 26.

Figure 4:
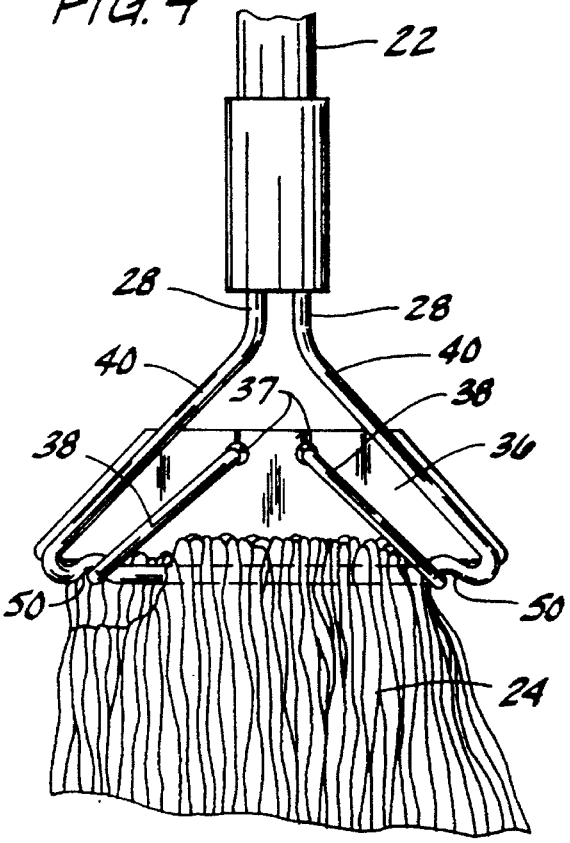
FIG. 4 is a view similar to FIG. 1 with the absorbent material secured to the mop.

As shown in FIG. 4, the plate 36 is urged toward the reaction surface 34 of the stirrups 40 by resilient elastic members 38, preferably ⅜ inch latex tubing, to secure the absorbent material 24 on the mop head 26. The resilient, elastic members 38 comprise the urging means. Each elastic member 38 is mounted on the plate 36 by extending through apertures 37 formed in the plate. Each resilient member 38 is sized to extend around the undersides of the stirrups 40 upon deformation of the resilient member (FIG. 3). Preferably, the underside of each stirrup 40 is formed with two notches, each indicated at 50, so that each resilient member 38 is received in a corresponding notch. So engaged, the resilient elastic members 38 are deformed from their relaxed states and force the freely movable plate 36 toward the reaction surface 34 of the stirrups 40 and into engagement with the absorbent material 24 (FIGS. 1 and 4). The resilient members 38 are sized and mounted on the plate 36 in such a position so that when the plate engages the absorbent material and the resilient members are received in their corresponding notches 50, the resilient members are still deformed from their relaxed states. The resilient members 38 are further selected to have a sufficient strength to hold the absorbent material 24 on the mop head 26 when the mop 20 is used for cleaning.

In operation, the absorbent material 24 must be secured to the handle 22. For this purpose, the plate 36 is placed in the release position and held there by the stirrups 40 which are arranged to be closer together near the handle (i.e., the guideway 42 narrows towards the upper portion of the stirrups). Thus, the plate 36 is frictionally retained in the release position by the stirrups 40. The absorbent material 24 is routed transversely through the stirrups 40 so that the absorbent material rests on the reaction surface 34 of the stirrups. The absorbent material 24 is positioned so that the gathered portion of the absorbent material 24 is positioned between the stirrups 40. The plate 36 is then moved to the clamp position by deforming the resilient members 38 to attach each one in its respective notch 50 in the undersides of the stirrups 40. The plate 36 is thereby forced towards the reaction surface 34 and into engagement with the absorbent material 24. The serrated portion 46 of the bottom 44 of the plate 36 tightly grips the absorbent material 24 to prevent the absorbent material from being laterally extracted from the mop head 26. The mop 20 is then in condition for use in cleaning.

After mopping is completed, the absorbent material 24 can be readily removed from the mop head 26. Each resilient member 38 is simply disconnected from its respective notch 50 in the bottom of the stirrup 40 and allowed to return to its relaxed state. The plate member 36 is then moved back to the release position where it is held by the stirrup 40.

It will be understood that a variety of different materials and configurations may be used for the mop head 26 without departing from the scope of the present invention depending on the size of the mop 20, the amount of the absorbent material 24, and other parameters.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A mop head for releasably securing absorbent mop material to a handle, the mop head comprising:

a mount for the absorbent material having a reaction surface thereon shaped and arranged for receiving the absorbent material thereacross, the mount comprising a pair of spaced apart mount members defining a guideway therebetween;

a clamp member disposed in the guideway and attached to the mop head for movement between a clamp position in which the clamp member is located relatively close to the reaction surface and is adapted to engage the absorbent material to clamp it against the reaction surface and a release position in which the clamp member is located relatively farther away from the reaction surface and is adapted to release the absorbent material for removal of the absorbent material from the mop head; and means for urging said clamp member toward the reaction surface, said urging means being selected to have sufficient strength to hold the absorbent material on the mop head when used for mopping.

2. A mop head as set forth in claim 1 wherein said mount members each comprise a stirrup of rigid material.

3. A mop head as set forth in claim 2 wherein the clamp member comprises a thin, flat plate received between the mount members.

4. A mop head as set forth in claim 3 wherein the plate and mount members are sized and shaped so that the plate protrudes laterally outwardly from between the mount members.

5. A mop head as set forth in claim 3 wherein the plate has a bottom edge having means for gripping the absorbent material thereon.

6. A mop head as set forth in claim 5 wherein said gripping means comprises serrations on the bottom edge of the plate.

7. A mop head as set forth in claim 1 wherein the clamp member comprises a thin, flat plate received in the guideway defined by the mount.

8. A mop head as set forth in claim 7 wherein the plate and mount are sized and shaped so that the plate protrudes laterally outwardly from opposite sides of the mount.

9. A mop head as set forth in claim 7 wherein the plate has a bottom edge having means for gripping the absorbent material thereon.

10. A mop comprising a handle, an absorbent material, and a mop head for securing the absorbent material to the handle, the mop head comprising a mount having a reaction surface thereon shaped and arranged for receiving the absorbent material thereacross, the mount of the mop head comprising a pair of spaced apart mount members defining a guideway therebetween, the mop head further comprising a clamp member disposed in the guideway and attached to the mop head for movement between a clamp position in which the clamp member is located relatively close to the reaction surface and is adapted to engage the absorbent material to clamp it against the reaction surface and a release position in which the clamp member is located relatively farther away from the reaction surface and is adapted to release the absorbent material for removal of the absorbent material from the mop head, and means for urging said clamp member toward the reaction surface, said urging means being selected to have sufficient strength to hold the absorbent material on the mop head when used for mopping.

11. A mop as set forth in claim 10 wherein said mount members each comprise a stirrup of rigid material.

12. A mop as set forth in claim 11 wherein the clamp member of the mop head comprises a thin, flat plate received between the mount members.

13. A mop as set forth in claim 12 wherein the plate and mount members are sized and shape so that the plate protrudes laterally outwardly from between the mount members.

14. A mop as set forth in claim 12 wherein the plate has a bottom edge having means for gripping the absorbent material thereon.

15. A mop as set forth in claim 14 wherein said gripping means comprises serrations on the bottom edge of the plate.

16. A mop as set forth in claim 10 wherein the clamp member of the mop head comprises a thin, flat plate received in the guideway defined by the mount.

17. A mop as set forth in claim 16 wherein the plate and mount are sized and shaped so that the plate protrudes laterally outwardly from opposite sides of the mount.

18. A mop as set forth in claim 16 wherein the plate has a bottom edge having means for gripping the absorbent material thereon.

* * * * *